US009579717B2

(12) United States Patent
Vempati et al.

(10) Patent No.: US 9,579,717 B2
(45) Date of Patent: Feb. 28, 2017

(54) METHODS OF FORMING EARTH-BORING TOOLS INCLUDING BLADE FRAME SEGMENTS

(71) Applicant: Baker Hughes Incorporated, Houston, TX (US)

(72) Inventors: Chaitanya K. Vempati, Conroe, TX (US); Suresh G. Patel, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 7 days.

(21) Appl. No.: 14/753,595

(22) Filed: Jun. 29, 2015

(65) Prior Publication Data

US 2015/0298209 A1 Oct. 22, 2015

Related U.S. Application Data

(63) Continuation of application No. 13/075,907, filed on Mar. 30, 2011, now Pat. No. 9,068,408.

(51) Int. Cl.
*B22D 19/06* (2006.01)
*E21B 10/56* (2006.01)
(Continued)

(52) U.S. Cl.
CPC ..... *B22D 19/06* (2013.01); *B22D 19/0081* (2013.01); *B22D 19/04* (2013.01);
(Continued)

(58) Field of Classification Search
CPC ..... B22D 19/06; B22D 19/04; B22D 19/14; B22D 19/0081; E21B 10/56; E21B 2010/545
(Continued)

(56) References Cited

U.S. PATENT DOCUMENTS 4,199,035 A * 4/1980 Thompson ..... E21B 10/56 175/413
4,646,857 A 3/1987 Thompson
(Continued)

OTHER PUBLICATIONS

International Preliminary Report on Patentability, for International Application No. PCT/US2012/029026, dated Oct. 1, 2013, 7 pages.
(Continued)

*Primary Examiner* — Sean Michalski
(74) *Attorney, Agent, or Firm* — TraskBritt

(57) ABSTRACT

Methods of forming earth-boring tools may involve positioning a blade frame segment in a mold, the blade frame segment comprising cutting-element-attachment locations distributed over a face of the blade frame segment, the mold comprising a longitudinal axis. A first cutting element may be secured to the blade frame segment at a first cutting-element-attachment location of the cutting-element-attachment locations. A second cutting element may be secured to the blade frame segment at a second, different cutting-element-attachment location of the cutting-element-attachment locations. The blade frame segment may be integrated into a blade of a plurality of radially extending blades of an earth-boring tool by forming a body of the earth-boring tool, including the blade, around the blade frame segment.

20 Claims, 11 Drawing Sheets

(51) Int. Cl.

| | |
|---|---|
| ***E21B 10/43*** | (2006.01) |
| ***B22D 19/00*** | (2006.01) |
| ***B22D 19/04*** | (2006.01) |
| ***B22D 19/14*** | (2006.01) |
| ***E21B 10/36*** | (2006.01) |
| *E21B 10/54* | (2006.01) |

(52) U.S. Cl.
CPC ..... *B22D 19/14* (2013.01); *E21B 10/36* (2013.01); *E21B 10/43* (2013.01); *E21B 10/56* (2013.01); *E21B 2010/545* (2013.01)

(58) Field of Classification Search
USPC ..... 76/108.2
See application file for complete search history.

(56) References Cited

U.S. PATENT DOCUMENTS 4,978,260 A 12/1990 Lynde et al.
5,037,704 A 8/1991 Nakai et al.
5,560,440 A 10/1996 Tibbitts
5,678,645 A 10/1997 Tibbitts et al.
7,237,628 B2 * 7/2007 Desai ..... E21B 10/55 175/406
7,571,782 B2 8/2009 Hall et al.
8,317,893 B2 * 11/2012 Stevens ..... B22D 19/06 175/374
2002/0035895 A1 * 3/2002 Davies ..... E21B 10/50 76/108.2
2005/0087371 A1 * 4/2005 Kembaiyan ..... B23B 27/148 175/435
2005/0247491 A1 11/2005 Mirchandani et al.
2007/0157763 A1 * 7/2007 Oldham ..... B23H 9/00 76/108.2
2007/0240910 A1 * 10/2007 Kembaiyan ..... C22C 1/051 175/374
2008/0011519 A1 * 1/2008 Smith ..... E21B 10/46 175/374
2009/0078470 A1 * 3/2009 Lyons ..... B23K 1/0006 175/435
2010/0089649 A1 * 4/2010 Welch ..... E21B 10/43 175/61
2010/0108403 A1 5/2010 Keshavan
2011/0315455 A1 * 12/2011 Stowe, II ..... E21B 10/55 175/398
2012/0247840 A1 10/2012 Vempati et al.
2013/0312927 A1 * 11/2013 Thomas ..... B22D 19/06 164/108
2014/0216827 A1 * 8/2014 Zhang ..... E21B 10/573 175/428
2016/0138343 A1 * 5/2016 Collins ..... B22D 19/06 175/327

OTHER PUBLICATIONS

International Search Report for International Application No. PCT/US2012/029026 dated Oct. 30, 2012, 4 pages.
International Written Opinion for International Application No. PCT/US2012/029026 dated Oct. 30, 2012, 6 pages.

* cited by examiner

METHODS OF FORMING EARTH-BORING TOOLS INCLUDING BLADE FRAME SEGMENTS

CROSS-REFERENCE TO RELATED APPLICATION

This application is a continuation of U.S. patent application Ser. No. 13/075,907, filed Mar. 30, 2011, now U.S. Pat. No. 9,068,408, issued Jun. 30, 2015, the disclosure of which is incorporated herein in its entirety by this reference.

FIELD

Embodiments of the present disclosure relate generally to methods of forming earth-boring tools and structures used during formation and use of earth-boring tools. More specifically, embodiments of the present disclosure relate to blade segments having cutting elements attached thereto and which may be attached to remainders of blades of an earth-boring tool.

BACKGROUND

Earth-boring tools for forming wellbores in subterranean earth formations may include a plurality of cutting elements secured to a body. For example, fixed-cutter earth-boring rotary drill bits (also referred to as "drag bits") include a plurality of cutting elements that are fixedly attached to a bit body of the drill bit, conventionally in pockets formed in blades and other exterior portions of the bit body. Rolling cone earth-boring drill bits include a plurality of cutters attached to bearing pins on legs depending from a bit body. The cutters may include cutting elements (sometimes called "teeth") milled or otherwise formed on the cutters, which may include hardfacing on the outer surfaces of the cutting elements, or the cutters may include cutting elements (sometimes called "inserts") attached to the cutters, conventionally in pockets formed in the cutters. Other bits might include impregnated bits that typically comprise a body having a face comprising a superabrasive impregnated material, conventionally a natural or synthetic diamond grit or thermally stable diamond elements dispersed in a matrix of surrounding body material or segments of matrix material brazed to the bit body.

The cutting elements used in such earth-boring tools often include polycrystalline diamond cutters (PDCs), which are cutting elements that include a polycrystalline diamond (PCD) material. Such polycrystalline diamond cutting elements are formed by sintering and bonding together relatively small diamond grains or crystals under conditions of high temperature and high pressure in the presence of a catalyst (such as, for example, cobalt, iron, nickel, or alloys and mixtures thereof) to form a layer of polycrystalline diamond material on a cutting element substrate. These processes are often referred to as high temperature/high pressure (or HTHP) processes. The cutting element substrate may comprise a cermet material (i.e., a ceramic-metal composite material) comprising a plurality of particles of hard material in a metal matrix, such as, for example, cobalt-cemented tungsten carbide. In such instances, catalyst material in the cutting element substrate may be drawn into the diamond grains or crystals during sintering and catalyze formation of a diamond table from the diamond grains or crystals. In other methods, powdered catalyst material may be mixed with the diamond grains or crystals prior to sintering the grains or crystals together in an HTHP process.

Exposed portions of cutting elements, such as, for example, diamond tables, portions of substrates, hardfacing disposed on the outer surfaces of cutting elements, and exposed surfaces of the earth-boring tool, such as, for example, blade surfaces, fluid course surfaces, and junk slot surfaces of a fixed-cutter drill bit or the cutters of a rolling cone drill bit, may be subject to failure modes, such as, for example, erosion, fracture, spalling, and diamond table delamination, due to abrasive wear, impact forces, and vibration during drilling operations from contact with the formation being drilled. Some portions of the earth-boring tool may be more susceptible to such failure modes, and localized wear and localized impact damage may cause the earth-boring tool to fail prematurely while leaving other portions of the earth-boring tool in a usable condition. For example, cutting elements and the blades to which they are attached may be more susceptible to failure at the shoulder region of a face of the bit body as compared to the cone and nose regions of the face of the bit body or the gage region of the bit body. In instances of cutting element failure or blade structure failure leading to cutting elements loss at a particular radial location from the bit centerline, an annular groove may wear into the face of the bit body at the shoulder region, a phenomenon sometimes referred to as "ring out." Further, cutting elements and the blades to which they are attached may be susceptible to failure within a central, core region of a drill bit located within the cone or nose regions of the face thereof, resulting in "core out." Other earth-boring tools may similarly exhibit localized wear in certain portions of the earth-boring tools.

To address such concerns, so-called "self-sharpening" tools have been proposed, for example, in U.S. Application Publication No. 2010/0089649 A1 published Apr. 15, 2010 to Welch et al., the disclosure of which is hereby incorporated herein in its entirety by this reference. Briefly, portions of an earth-boring tool, such as, for example, portions of the blades of a fixed-cutter bit, may wear away during drilling and expose embedded or partially embedded cutting elements at the same radial locations to begin engaging the formation as cutting elements that were originally exposed at those radial locations to engage the formation fail and become detached from the earth-boring tool. Due to the complexity and difficulty of positioning and embedding or partially embedding the cutting elements within the earth-boring tools, however, such self-sharpening tools have been difficult and costly to manufacture.

BRIEF SUMMARY

In some embodiments, the disclosure includes earth-boring tools comprising a body comprising a plurality of radially extending blades. At least one blade of the plurality of radially extending blades comprises a blade support segment integral with the body. A blade frame segment is attached to a rotationally leading portion of the blade support segment. A plurality of cutting elements is attached to the blade frame segment.

In other embodiments, the disclosure includes methods of forming an earth-boring tool comprising forming a body including a blade support segment of at least one blade. At least one blade frame segment is attached to the support segment of the at least one blade. A plurality of cutting elements is secured to the at least one blade segment.

In still further embodiments, the disclosure includes intermediate structures for forming an earth-boring drill bit comprising a plurality of interconnected blade frame segments extending from a central support member. Each blade frame segment has a plurality of pockets configured to receive a plurality of cutting elements at least partially therein. A first pocket of the plurality of pockets is located at a first radial distance from the central support member and at a first longitudinal position along the central support member. At least another pocket of the plurality of pockets is located at a second radial distance at least substantially equal to the first radial distance from the central support member and at a second longitudinal position different from the first longitudinal position along the central support member.

BRIEF DESCRIPTION OF THE DRAWINGS

While the specification concludes with claims particularly pointing out and distinctly claiming that which is regarded as the present invention, various features and advantages of embodiments of the invention may be more readily ascertained from the following description of embodiments of the invention when read in conjunction with the accompanying drawings, in which:

DETAILED DESCRIPTION

Figure 1:
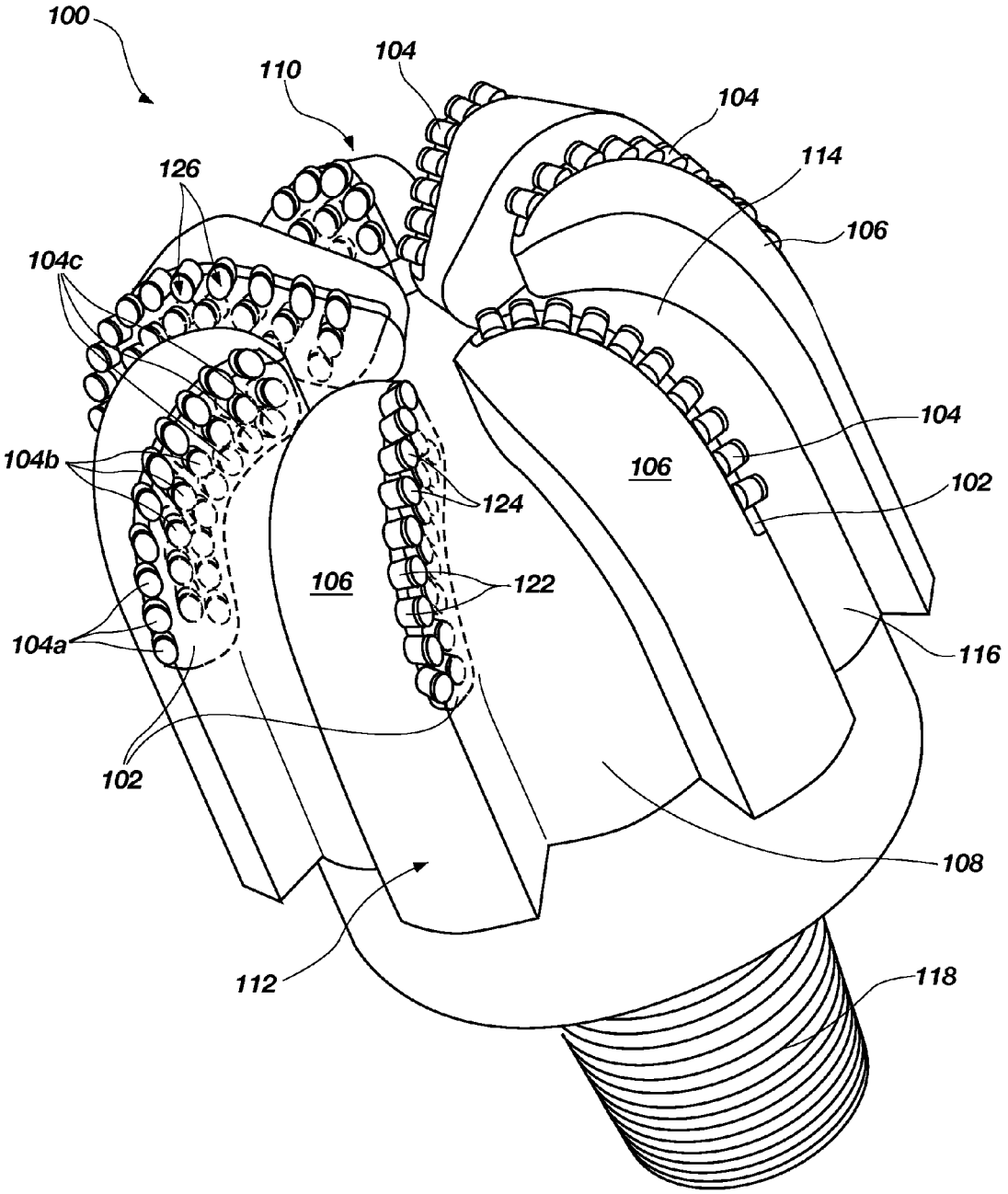
FIG. 1 is a perspective view of an earth-boring tool including blade segments having cutting elements secured thereto and attached to remainders of blades.

The illustrations presented herein are not meant to be actual views of any particular earth-boring tool, cutting element, or blade segment, but are merely idealized representations that are employed to describe the embodiments of the disclosure. Additionally, elements common between figures may retain the same or similar numerical designation.

Embodiments of the disclosure relate to apparatuses and methods for forming self-sharpening earth-boring tools. More particularly, embodiments of the present disclosure relate to blade frame segments having cutting elements attached thereto and secured to support segments of blades of an earth-boring tool.

The terms "earth-boring tool" and "earth-boring drill bit," as used herein, mean and include any type of bit or tool used for drilling during the formation or enlargement of a wellbore in a subterranean formation and include, for example, fixed-cutter bits, roller cone bits, percussion bits, core bits, eccentric bits, bicenter bits, reamers, mills, drag bits, hybrid bits, stabilizers, fishing tools, casing drilling tools, milling tools, and other drilling bits and tools known in the art.

As used herein, the term "polycrystalline structure" means and includes any structure comprising a plurality of grains (i.e., crystals) of material (e.g., superabrasive material) that are bonded directly together by inter-granular bonds. The crystal structures of the individual grains of the material may be randomly oriented in space within the polycrystalline material.

As used herein, the terms "inter-granular bond" and "interbonded" mean and include any direct atomic bond (e.g., covalent, metallic, etc.) between atoms in adjacent grains of superabrasive material.

The term "sintering," as used herein, means temperature driven mass transport, which may include densification and/or coarsening of a particulate component, and typically involves removal of at least a portion of the pores between the starting particles (accompanied by shrinkage) combined with coalescence and bonding between adjacent particles.

As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide.

As used herein, the term "substantially equal" in the context of radial positions of a cutting element relative to another cutting element means and includes cutting element positions wherein a cutting face or other lateral dimension of each cutting element, taken generally transverse to a direction of intended rotation of a blade to which both cutting elements are mounted, is at least immediately proximate, in a radial direction, to the cutting face or other lateral dimension of the other cutting element. Non-limiting examples of "substantially equal" radial positioning of cutting elements include full radial overlap of lateral dimensions, partial overlap of lateral dimensions, and laterally abutting with respect to a longitudinal reference line parallel to a longitudinal axis of the earth-boring drill bit.

Referring to FIG. 1, an earth-boring tool 100 including blade frame segments 102 having cutting elements 104 secured thereto and attached to support segments of blades 106 at a rotationally leading portion of the support segments of the blades 106 is shown. The earth-boring tool 100 may be a fixed-cutter drill bit, for example, and may comprise a body 108 having blades, which comprise the blade frame segments 102 attached to the support segments of blades 106, that extend generally radially outward across at least a portion of the face 110 of the earth-boring tool 100 and longitudinally downward (as earth-boring tool 100 is oriented in FIG. 1) to a gage region 112 of the earth-boring tool 100. Fluid courses 114 may be disposed between the blades and may extend to junk slots 116 at the gage region 112 configured to provide a flow path for drilling fluid and cuttings suspended therein to flow away from the face 110 and out of a borehole in which the earth-boring tool 100 may be deployed. A shank 118 configured for attachment to a drill string may be disposed at an end of the body 108 opposing the face 110.

Each blade frame segment 102 may include a plurality of cutting elements 104 secured within pockets 120 formed in the blade frame segment 102. The cutting elements 104 may comprise a substrate 122 comprising a hard material suitable for use in earth-boring applications. The hard material may comprise, for example, a ceramic-metal composite material (i.e., a "cermet" material) comprising a plurality of hard ceramic particles dispersed throughout a metal matrix material. The hard ceramic particles may comprise carbides, nitrides, oxides, and borides (including boron carbide ($B_4C$)). More specifically, the hard ceramic particles may comprise carbides and borides made from elements such as W, Ti, Mo, Nb, V, Hf, Ta, Cr, Zr, Al, and Si. By way of example and not limitation, materials that may be used to form hard ceramic particles include tungsten carbide, titanium carbide (TiC), tantalum carbide (TaC), titanium diboride ($TiB_2$), chromium carbides, titanium nitride (TiN), aluminum oxide ($Al_2O_3$), aluminum nitride (AlN), and silicon carbide (SiC). The metal matrix material of the ceramic-metal composite material may include, for example, cobalt-based, iron-based, nickel-based, iron- and nickel-based, cobalt- and nickel-based, and iron- and cobalt-based alloys. The matrix material may also be selected from commercially pure elements, such as, for example, cobalt, iron, and nickel. As a specific, non-limiting example, the hard material may comprise a plurality of tungsten carbide particles in a cobalt matrix, known in the art as cobalt-cemented tungsten carbide. The substrate 122 may be, for example, at least substantially cylindrical in shape.

The cutting elements 104 may also comprise a polycrystalline structure 124 attached to an end of the substrate 122. The polycrystalline structure 124 may comprise a cutting face 126 of the cutting element 104 configured to engage an underlying earth formation. Thus, the polycrystalline structure 124 may be disposed at a rotationally leading end of the substrate 122. The polycrystalline structure 124 may comprise a superabrasive, also referred to as "superhard," material. The superabrasive material may comprise, for example, synthetic diamond, natural diamond, a combination of synthetic and natural diamond, cubic boron nitride, carbon nitrides, and other superabrasive materials known in the art. The polycrystalline structure 124 may be, for example, at least substantially cylindrical, disc-shaped, dome-shaped, chisel-shaped, at least substantially conic, or may have other shapes known in the art for a polycrystalline structure configured to engage an underlying earth formation.

In further embodiments, the cutting elements 104 may comprise freestanding superabrasive bodies which may comprise, for example, synthetic diamond, natural diamond, a combination of synthetic and natural diamond, cubic boron nitride, carbon nitrides, and other superabrasive materials known in the art. Such cutting elements 104 may be, for example, at least substantially cylindrical, disc-shaped, dome-shaped, chisel-shaped, at least substantially conic, or may have other shapes known in the art for a polycrystalline structure configured to engage an underlying earth formation. Particularly suitable freestanding superabrasive bodies are so-called Thermally Stable Products (TSPs) which are polycrystalline diamond bodies formed or treated to exhibit thermal stability at temperatures in excess of 750° C.

At least one of the cutting elements 104 may be at least partially exposed and located to engage an underlying earth formation upon initial deployment of the earth-boring tool 100. For example, a first plurality of cutting elements **104*a* may be partially exposed with a portion of the cutting elements 104*a* secured and, optionally, concealed within pockets 120 formed in the blade frame segments 102 and another portion of the cutting elements 104*a* exposed above the face 110 of the earth-boring tool 100. At least one of the cutting elements 104 may be at least partially exposed and configured to engage an underlying earth formation only after another cutting element, such as, for example, a cutting element of the first plurality of cutting elements 104*a*, has become detached from the earth-boring tool 110. For example, a second plurality of cutting elements 104*b* may be partially exposed with a portion of the cutting elements 104*b* concealed within pockets 120 formed in the blade frame segments 102 and embedded (as indicated in dashed lines) within the remainders of the blades 106 and another portion of the cutting elements 104*b* exposed at a location longitudinally below the face 110 of the earth-boring tool 100. In some embodiments, at least one of the cutting elements 104 may be at least partially embedded (as indicated with dashed lines) and configured to engage an underlying earth formation only after other cutting elements, such as, for example, cutting elements of the first and second pluralities of cutting elements 104*a* and 104*b*, have become detached from the earth-boring tool 110. For example, a third plurality of cutting elements 104*c* may be at least substantially completely embedded within the remainders of the blades 106 and secured within pockets 120 formed in the blade frame segments 102. Thus, at least a portion of the blade frame segments 102 may also be substantially embedded and, optionally, concealed within portions of the remainders of the blades 106**.

Figure 2:
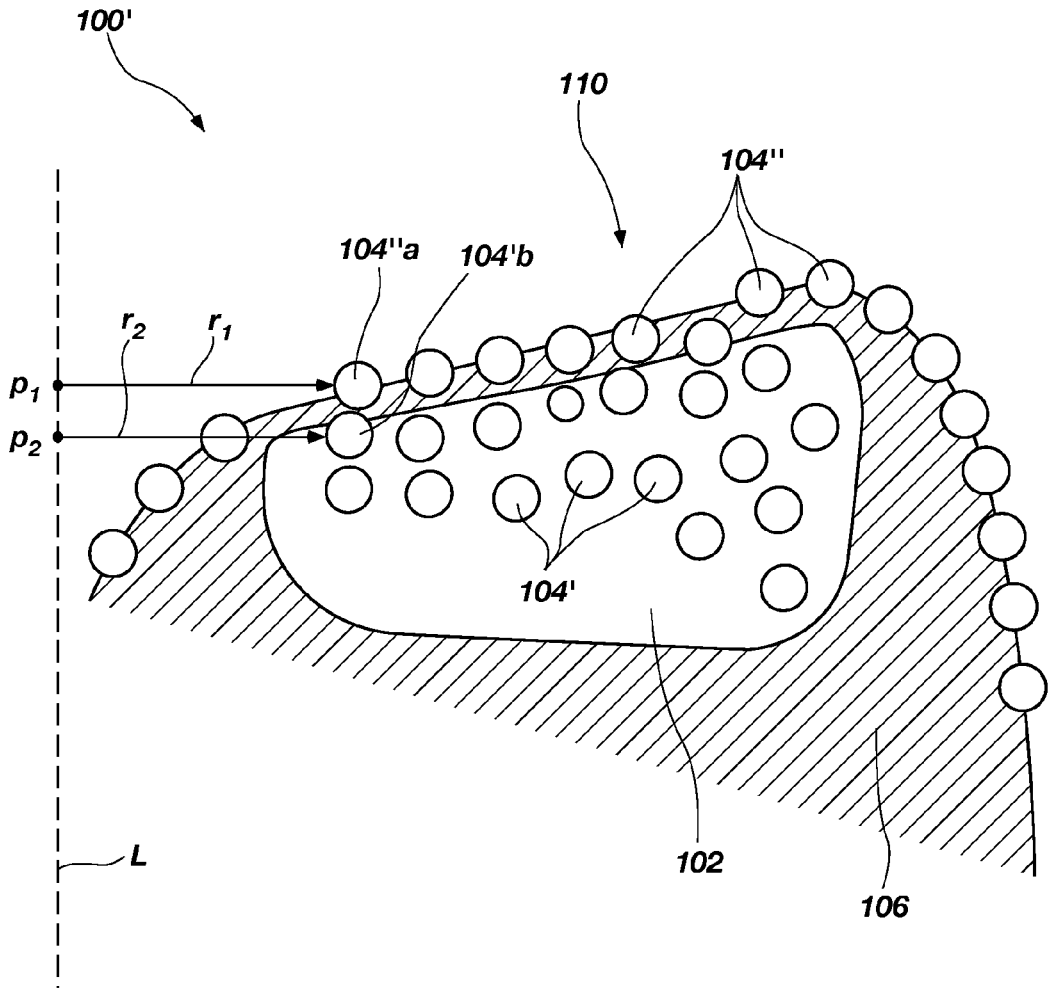
FIG. 2 depicts a cross-sectional view of a portion of an earth-boring tool similar to the earth-boring tool of FIG. 1 showing a blade segment.

Referring to FIG. 2, a cross-sectional view of a portion of an earth-boring tool 100', similar to the earth-boring tool 100 of FIG. 1, is shown. The earth-boring tool 100' includes at least one blade frame segment 102 attached to a support segment comprising a remainder of a blade 106. A first plurality of cutting elements 104' may be attached to the at least one blade frame segment 102. Another plurality of cutting elements 104" may be attached to the remainder of the blade 106. The other plurality of cutting elements 104" may include cutting elements configured to engage an underlying earth formation upon deployment of earth-boring tool 100', and the first plurality of cutting elements 104' may include at least some cutting elements configured to engage an underlying earth formation only after at least one other cutting element, such as, for example, one of the other plurality of cutting elements 104", has become detached from the at least one blade frame segment 102, broken, or worn away. For example, a first cutting element 104"a may be located a first radial distance $r_1$ from and at a first position $p_1$ along a longitudinal axis L of the earth-boring tool 100. Another cutting element 104'b may be located another radial distance $r_2$, at least substantially equal to the first radial distance $r_1$, from and at another longitudinal position $p_2$, different from the first position $p_1$, along the longitudinal axis L of the earth-boring tool 100. The other position $p_2$ may be farther from the face 110 of the earth-boring tool 100 than the first position $p_1$. At least one cutting element 104" of the other plurality of cutting elements 104" may only be configured to engage an underlying earth formation beginning at deployment and ending at detachment or other failure, there being no replacement cutting element configured to engage the underlying earth formation after it becomes detached or otherwise fails.

Though the cutting elements 104 shown in FIG. 2 form one possible cutting profile, different cutting profiles may be used. For example, one blade of an earth-boring tool 100 may have a first cutting profile and another blade of the earth-boring tool 100 may have another, different cutting profile. Thus, the cutting element 104 positioning on the remainder of the blade 106 and on the blade frame segment 102 may differ from blade to blade on one earth-boring tool 100. In addition, the size (e.g., the diameter, the thickness, etc.) and orientation (e.g., rake angle) of cutting elements 104 may differ from blade to blade and even between cutting elements 104 on the same blade.

Figure 3:
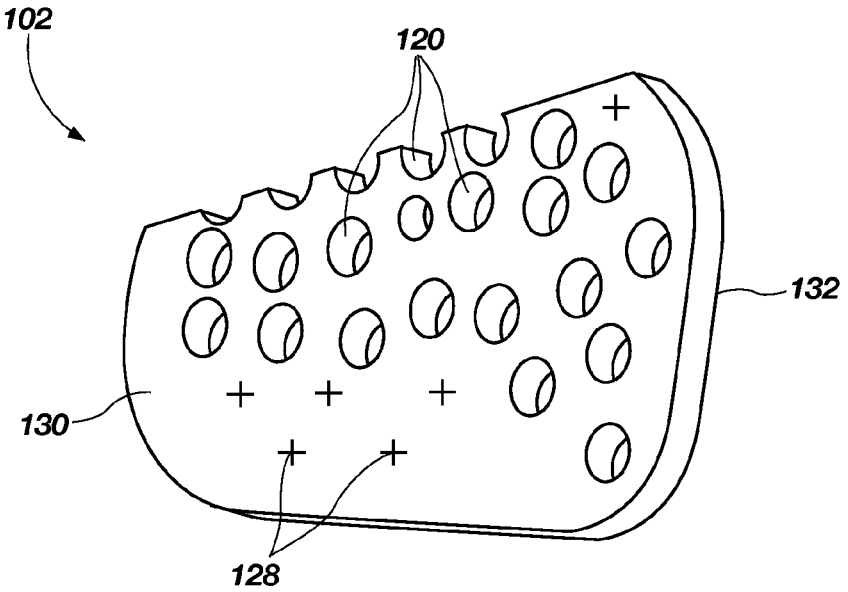
FIGS. 3 and 4 illustrate perspective views of embodiments of blade segments that may be attached to earth-boring tools.

Referring to FIG. 3, an embodiment of a blade frame segment 102 is shown. The blade frame segment 102 may comprise an at least substantially planar member configured to be attached to a support segment comprising a remainder of a blade 106 (see FIG. 1) at a rotationally leading portion thereof. The blade frame segment 102 may comprise a rotationally leading surface 130 and a rotationally following surface 132. A thickness of the blade frame segment 102 may be less than a thickness of a cutting element 104 (see FIG. 5) that may be attached thereto such that the cutting element 104 protrudes from the rotationally leading surface 130 of the blade frame segment 102. The blade frame segment 102 may include a plurality of pockets 120 sized and configured to receive a plurality of cutting elements 104 (see FIG. 5) at least partially therein. At least one pocket of the plurality of pockets 120 may be formed to enable portions of cutting elements 104 (see FIG. 5) to extend above the blade frame segment 102, for example, to engage an underlying earth formation. Thus, some pockets of the plurality of pockets 120 may be formed as at least substantially cylindrical holes extending from the rotationally leading surface 130 of the blade frame segment 102 toward the rotationally following surface 132 of the blade frame segment 102 and located completely within the body of the blade frame segment 102, while others of the plurality of pockets 120 may be formed as portions of at least substantially cylindrical holes located at a periphery of the blade frame segment 102 and exhibit a scalloped configuration. In some embodiments, the plurality of pockets 120 may extend from the rotationally leading surface 130 to the rotationally following surface 132, while the plurality of pockets 120 may extend from the rotationally leading surface 130 to a location within the body of the blade frame segment 102 closer to the rotationally leading surface 130 than the rotationally following surface 132 in other embodiments. In addition or in the alternative, the blade frame segment 102 may include a plurality of placement markings 128, shown here as crosshairs though any suitable placement marking may be used, such as, for example, a circle, concentric circles, an "x," etc. The plurality of placement markings 128 and the pockets 120 may be located at positions where it is desired to place cutting elements 104 (see FIG. 5). For example, cutting elements 104 may be inserted at least partially into the pockets 120 (see FIG. 5) or may be secured to the rotationally leading surface 130 of the blade frame segment 102 at the locations of the plurality of placement markings 128 (see FIG. 5). The placement markings 128 and the pockets 120, thus, may enable precise placement of the cutting elements (see FIG. 5).

Figure 4:
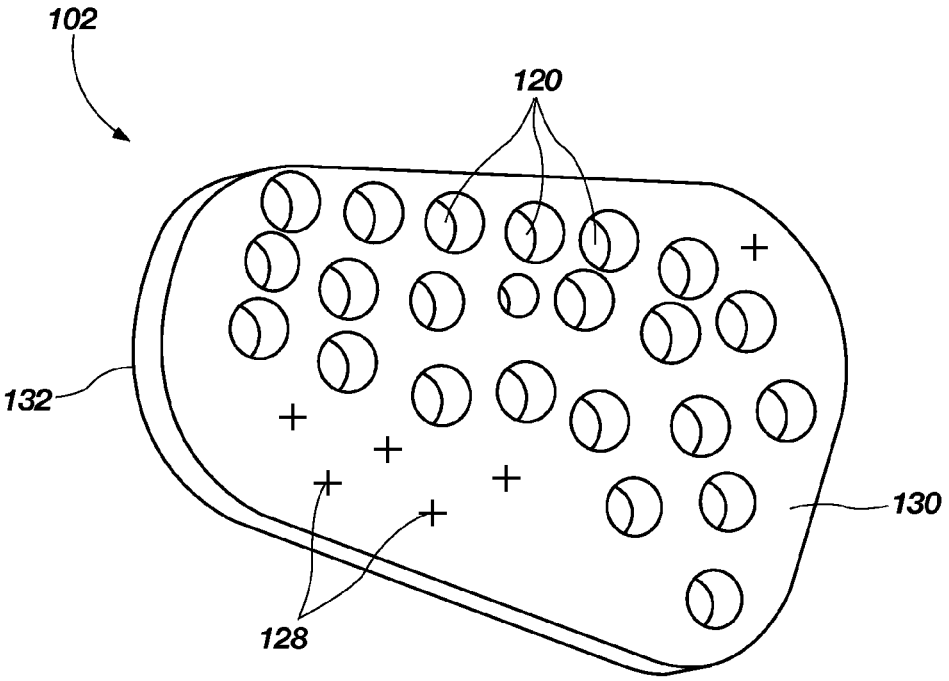

Referring to FIG. 4, another embodiment of a blade frame segment 102 is shown. The blade frame segment 102 includes a plurality of pockets 120 sized and configured to receive a plurality of cutting elements 104 (see FIG. 6) at least partially therein. The plurality of pockets 120 may be formed as at least substantially cylindrical holes extending from the rotationally leading surface 130 of the blade frame segment 102 toward the rotationally following surface 132 of the blade frame segment 102. Each of the pockets of the plurality of pockets 120 may have a cross-section comprising a closed geometric shape, such as, for example, a circle, within the body of the blade frame segment 102. Thus, there may not be any pockets of the plurality of pockets 120 disposed at the periphery of the blade frame segment 102 and comprising, for example, a portion of a cylindrical hole above which a cutting element 104 (see FIG. 6) may extend.

Figure 5:
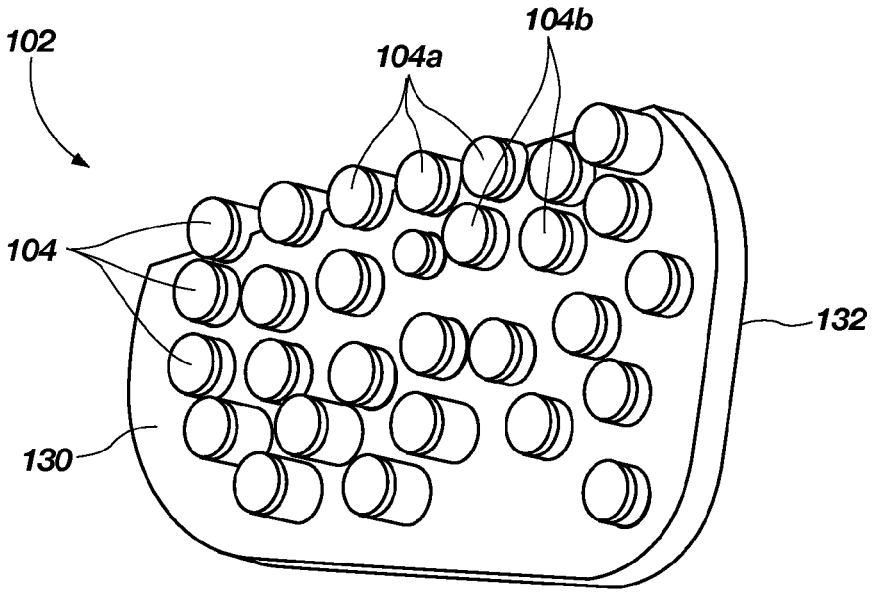
FIGS. 5 and 6 are perspective view of the blade segments shown in FIGS. 3 and 4, respectively, and having cutting elements attached thereto.

Referring to FIG. 5, the blade frame segment 102 of FIG. 3 is shown having cutting elements 104 attached thereto. Some of the cutting elements 104 may be secured within the plurality of pockets 120 formed in the blade frame segment 102. With regard to others of the cutting elements 104, an end of the other cutting elements 104 opposing the polycrystalline structure 124 may be attached to the rotationally leading surface 130 of the blade frame segment 102, for example, at locations that were marked with placement markings 128 (see FIG. 3). At least one of the cutting elements 104, such as, for example, cutting elements 104*a*, may extend above a periphery of the blade frame segment 102 such that they may engage an underlying earth formation when the blade frame segment 102 is initially deployed with an earth-boring tool 100 (see FIG. 1). At least another of the cutting elements 104, such as, for example, cutting elements 104*b*, may be located within the periphery of the body of the blade frame segment 102 and may not engage an underlying earth formation until at least one of the cutting elements 104, such as, for example, cutting elements 104*a*, becomes detached from the blade frame segment 102.

Figure 6:
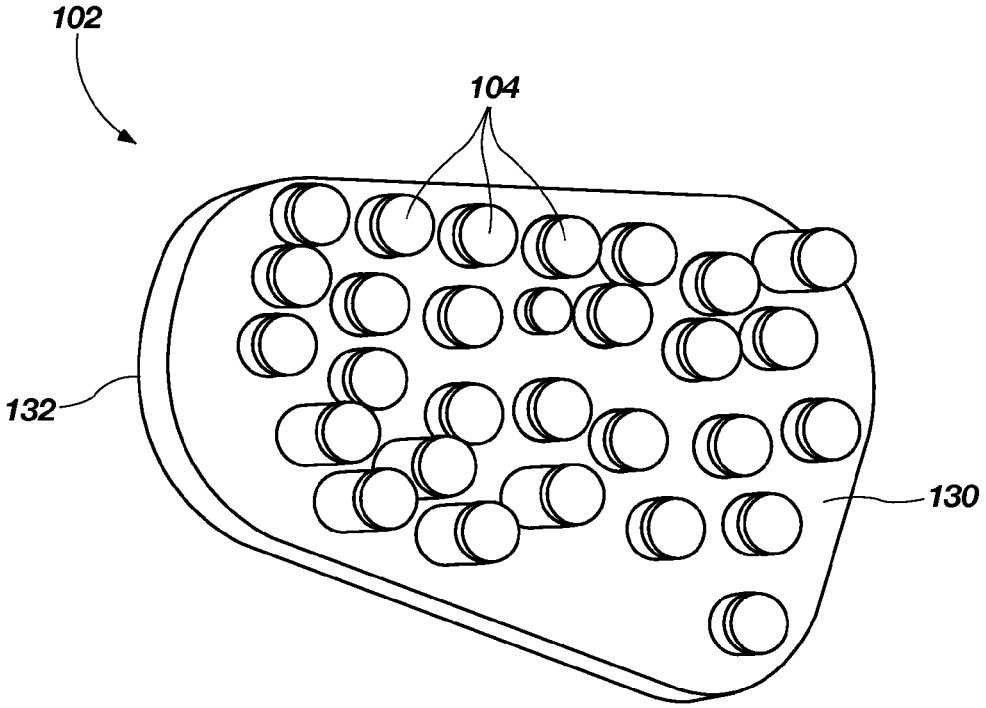

Referring to FIG. 6, the blade frame segment 102 of FIG. 4 is shown having cutting elements 104 attached thereto. Some of the cutting elements 104 may be secured within the pockets 120 formed in the blade frame segment 102. With regard to others of the cutting elements 104, an end of the other cutting elements 104 opposing the polycrystalline structure 124 may be attached to the rotationally leading surface 130 of the blade frame segment 102, for example, at locations that were marked with placement markings 128 (see FIG. 4). Each of the cutting elements 104 may be located within the body of the blade frame segment 102 such that none of the cutting elements 104 engages an underlying earth formation when initially deployed with an earth-boring tool 100 (see FIG. 2). In such embodiments, cutting elements that are attached to a remainder of a blade 106 and are configured to engage an underlying earth formation when the earth-boring tool 100 is initially deployed, such as cutting elements 104" shown in FIG. 2, may be located at radial distances at least substantially equal to the radial distances of the cutting elements 104 attached to the blade frame segment 102.

Blade frame segments 102, such as, for example, those shown in FIGS. 3 through 6, may be formed using conventional processes known in the art. For example, the blade frame segments 102 may be formed using sintering processes, hot isostatic pressing processes, machining, and other processes suitable for forming a part for use in earth-boring applications and dependent upon the material selected for the blade frame segment 102.

Figure 7:
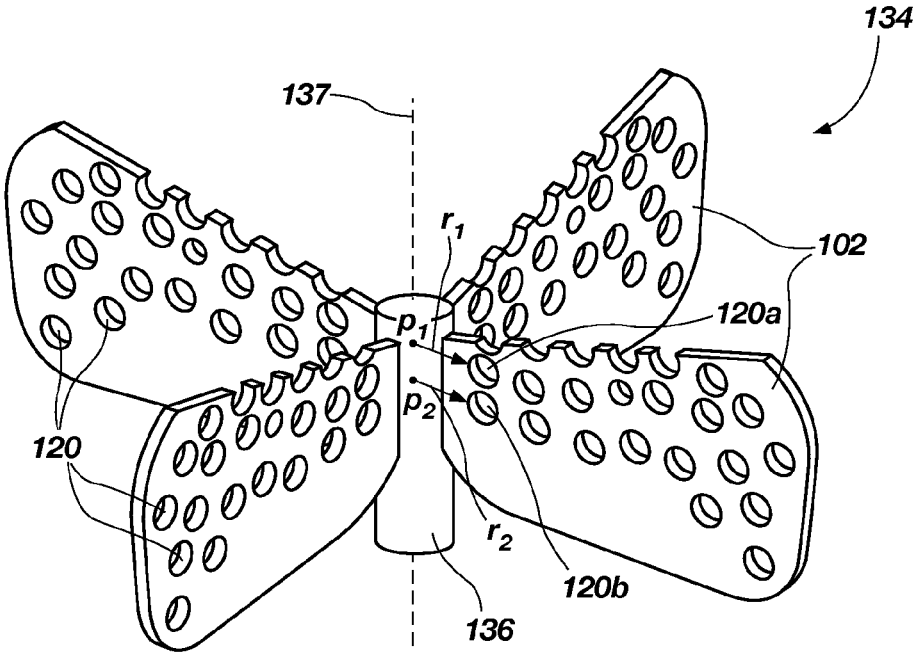
FIGS. 7 and 8 depict perspective views of support structures including a plurality of blade segments.

Referring to FIG. 7, an embodiment of a support structure 134 including a plurality of blade frame segments 102 is shown. The blade frame segments 102 may be at least substantially similar to that shown in FIG. 3. The plurality of blade frame segments 102 may be attached to one another using, for example, a central support member 136. The blade frame segments 102 may extend radially from the central support member 136. A central axis 137 of the central support member 136 may correspond to and align with a longitudinal axis L of a body 108 of an earth-boring tool 100 (see FIG. 2). Thus, a first pocket 120*a* may be located a first radial distance $r_1$ from and at a first position $p_1$ along the central axis 137 of the central support member 136. Another pocket 120*b* may be located another radial distance $r_2$, at least substantially equal to the first radial distance $r_1$, from and at another longitudinal position $p_2$, different from the first position $p_1$, along the central axis 137 of the central support member 136. The angular position of each of the blade frame segments 102 about central support member 136 may correspond to an angular position of a corresponding blade for an earth-boring tool 100 (see FIG. 1) of which that blade frame segment 102 forms a part. Thus, the support structure 134 may be configured to form portions of blades comprising the blade frame segments 102. The support structure 134 may enable precise placement of the blade frame segments 102 with respect to a body 108 (see FIG. 1) due to the fixed attachment of the blade frame segments 102 to the central support member 136.

The central support member 136 may be formed integrally with the blade frame segments 102 in some embodiments. In other embodiments, the blade segments and the central support member 136 may be formed separately from one another. In such embodiments, the blade frame segments 102 may be subsequently attached to the central support member by, for example, brazing, welding, bolting, and mechanical interference (e.g., using a mortise and tenon joint). Conventional processes, such as those described in connection with formation of the blade frame segments 102, may be used to form the central support member 136.

Figure 8:
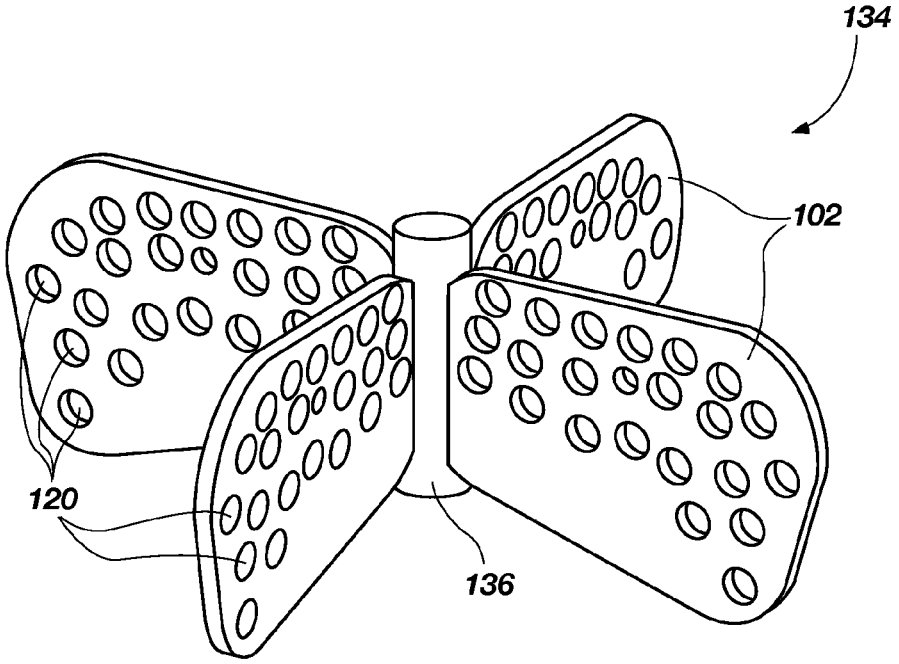

Referring to FIG. 8, another embodiment of a support structure 134 including a plurality of blade frame segments 102 is shown. The plurality of blade frame segments 102 may be at least substantially similar to that shown in FIG. 4. The plurality of blade frame segments 102 may be attached to one another using, for example, a central support member 136. The plurality of blade frame segments 102 may extend radially from the central support member 136. The angular position of the plurality of blade frame segments 102 may correspond to an angular position of a blade for an earth-boring tool 100 (see FIG. 2). Thus, the support structure 134 may be configured to form portions of blades comprising the plurality of blade frame segments 102. The support structure 134 may enable precise placement of the plurality of blade frame segments 102 with respect to a body 108 (see FIG. 2) due to the fixed attachment of the plurality of blade frame segments 102 to the central support member 136.

Blade frame segments 102 and support structures 134 comprising blade frame segments 102, such as, for example, those shown in FIGS. 1 through 8, may comprise a hard material suitable for use in earth-boring applications. For example, the hard material of the blade frame segments 102 and support structures 134 comprising blade frame segments 102 may comprise a ceramic-metallic composite material (i.e., a cermet material), such as any of the cermet materials described previously in connection with the substrate 122 of the cutting elements 104. Other materials are also contemplated. For example, the hard material of the blade frame segments 102 and support structures 134 comprising blade frame segments 102 may comprise metals or metal alloys, such as, for example, steel, copper, aluminum, and alloys thereof, or ceramics, such as, for example, oxides and carbides of elements such as, for example, tungsten or silicon. The blade frame segment 102 may also, for example, be coated or impregnated with other materials, such as, for example, fluoropolymers (e.g., a TEFLON® material), or a superabrasive material (e.g., diamond or cubic boron nitride grit, diamond film, etc.). Thus, the blade frame segments 102 and the support structures 134 comprising blade frame segments 102 may enable use of a wide range of materials in the blades of an earth-boring tool 100. In addition, the blade frame segments 102 and the support structures 134 comprising blade frame segments 102 may comprise combinations of materials. For example, the rotationally leading surface 130 of the blade frame segments 102 may comprise a relatively brittle, but abrasion-resistant material, such as, for example, a ceramic material, a cermet material, or a superabrasive material as described previously. In addition or in the alternative, the remainder of the body of the blade frame segments 102 and the central support member 136 of the support structures 134 may comprise a relatively ductile and less abrasion-resistant material, such as, for example, a metal or metal alloy as described previously.

Figure 9:
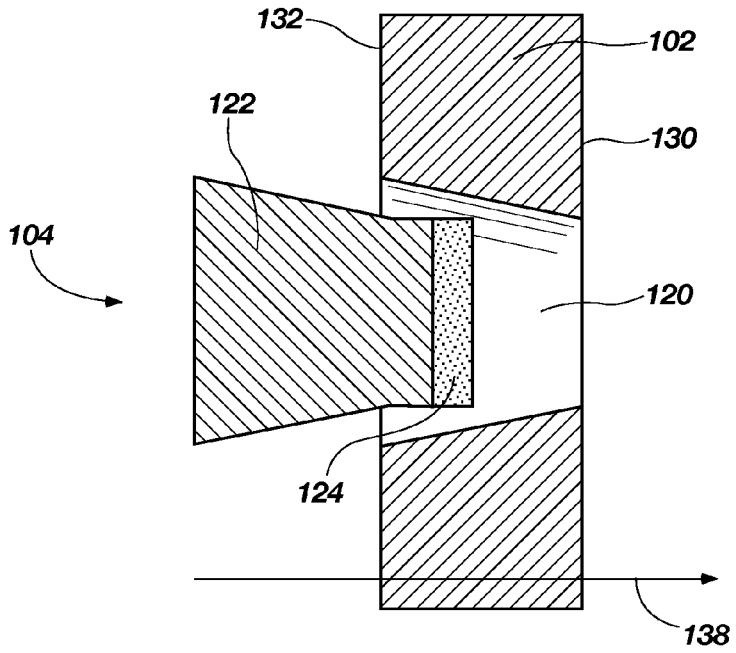
FIG. 9 illustrates a cross-sectional view of a cutting element configured for insertion into a pocket formed in a blade segment.

Referring to FIG. 9, a cutting element 104 configured for insertion into a pocket 120 formed in a blade frame segment 102 is shown. The cutting element 104 includes a polycrystalline structure 124 attached to an end of a substrate 122. The polycrystalline structure 124 may be disc-shaped. The substrate 122 may include a frustoconical portion, the diameter of the substrate decreasing in a direction of intended rotation, generally indicated by arrow 138. The pocket 120 formed in the blade frame segment 102 may also be frustoconical in shape. Thus, the shapes of the cutting element 104 and the pocket 120 may enable the cutting element to be inserted into the pocket 120 at the rotationally following surface 132 of the blade frame segment 102, through the body of the blade frame segment 102, and beyond the rotationally leading surface 130 of the blade frame segment 102. Thus, at least the polycrystalline structure 124, and a portion of the substrate 122 in some embodiments, may protrude beyond the rotationally leading surface 130 of the blade frame segment 102. The cooperating frustoconical shape of the substrate 122 and the pocket 120 may enable the cutting element 104 to be secured to the blade frame segment 102 using only mechanical interference. Other exemplary configurations for securing cutting elements 104 within pockets 120 using mechanical interference are disclosed in U.S. Pat. No. 5,678,645 issued Oct. 21, 1997 to Tibbitts et al. For example, a locking ring, a frustoconical taper where the diameter of the substrate increases in a direction of intended rotation, a mortise and tenon configuration, and a helical screw thread may be used in isolation or in combination to secure a cutting element 104 within a pocket 120 using mechanical interference.

Figure 10:
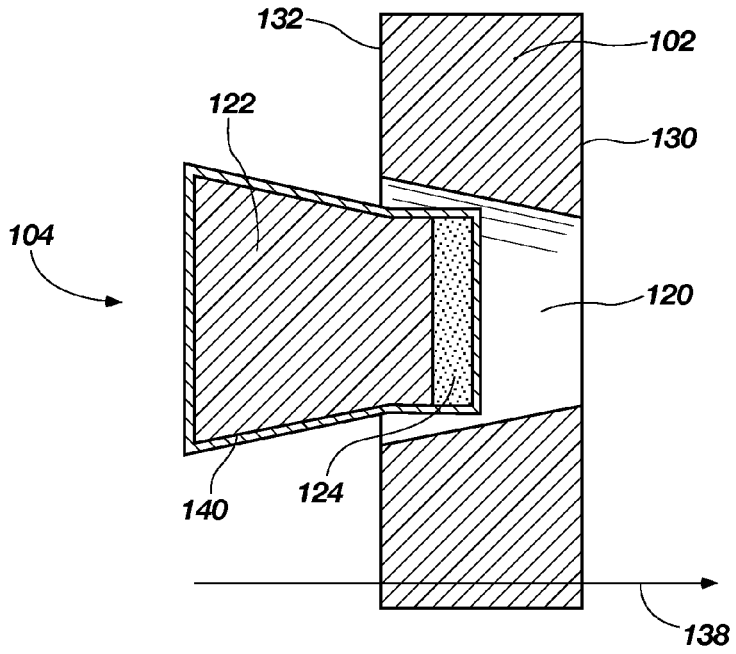
FIG. 10 is a cross-sectional view of another embodiments of a cutting element configured for insertion into a pocket formed in a blade segment.

Referring to FIG. 10, another cutting element 104 configured for insertion into a pocket 120 formed in a blade frame segment 102 is shown. The cutting element 104 may be coated with a protective material 140 prior to insertion into the pocket 120. For example, the cutting element 104 may be coated using methods described in U.S. Pat. No. 5,037,704 issued Aug. 6, 1991 to Nakai et al., the disclosure of which is hereby incorporated herein by this reference, or other coating techniques known in the art. The protective material 140 may comprise, for example, tungsten, nickel, or alloys thereof. In some embodiments, the protective material 140 may comprise, for example, a braze material. After insertion into the pocket 120, the cutting element 104 may be heated and brazed to attach it to the blade frame segment 102 using the protective material 140 in such embodiments.

Thus, the cutting element 104 may be attached to the blade frame segment 102 by a combination of mechanical interference and brazing.

Figure 11:
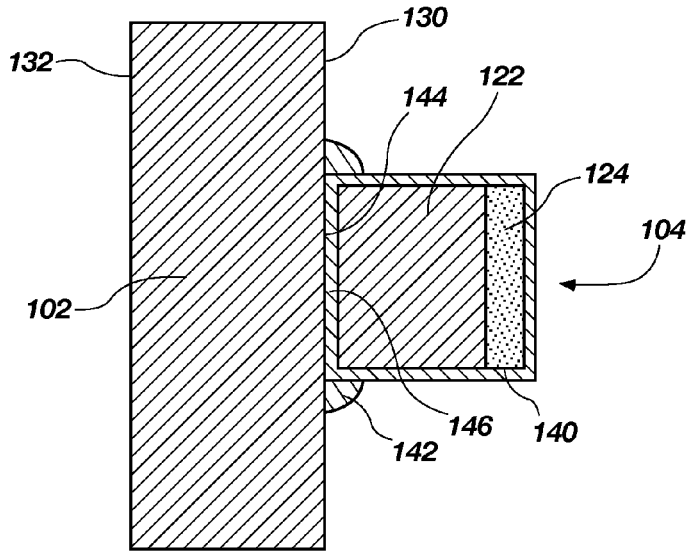
FIG. 11 depicts a cutting element configured for attachment to a rotationally leading surface of a blade segment.

Referring to FIG. 11, a cutting element 104 configured for attachment to the rotationally leading surface 130 of a blade frame segment 102 is shown. The cutting element 104, or a rotationally following surface 144 thereof, as mounted to blade frame segment 102, may be coated with a protective material 140, such as, for example, the materials described previously in connection with FIG. 10. In embodiments where the protective material comprises a braze material, the cutting element 104 may be brazed to the rotationally leading surface 130 of the blade frame segment 102. In some embodiments, a weld bead 142 may be disposed at an edge formed by the intersection of a rotationally following surface 144 of the cutting element 104 and the rotationally leading surface 130 of the blade frame segment 102. Thus, the cutting element 104 may be attached to the rotationally leading surface 130 of the blade frame segment 102 by at least one of brazing and welding. The braze 146, weld bead 142, or combination weld bead 142 and braze 146 may enable the cutting element 104 to more easily detach from the blade frame segment 102. This may be desirable, for example, in cutting elements, such as cutting elements 104*a* shown in FIG. 1, which may become detached from the earth-boring tool 100 to expose other new cutting elements, such as cutting elements 104*b* and 104*c* shown in FIG. 1.

Figure 12:
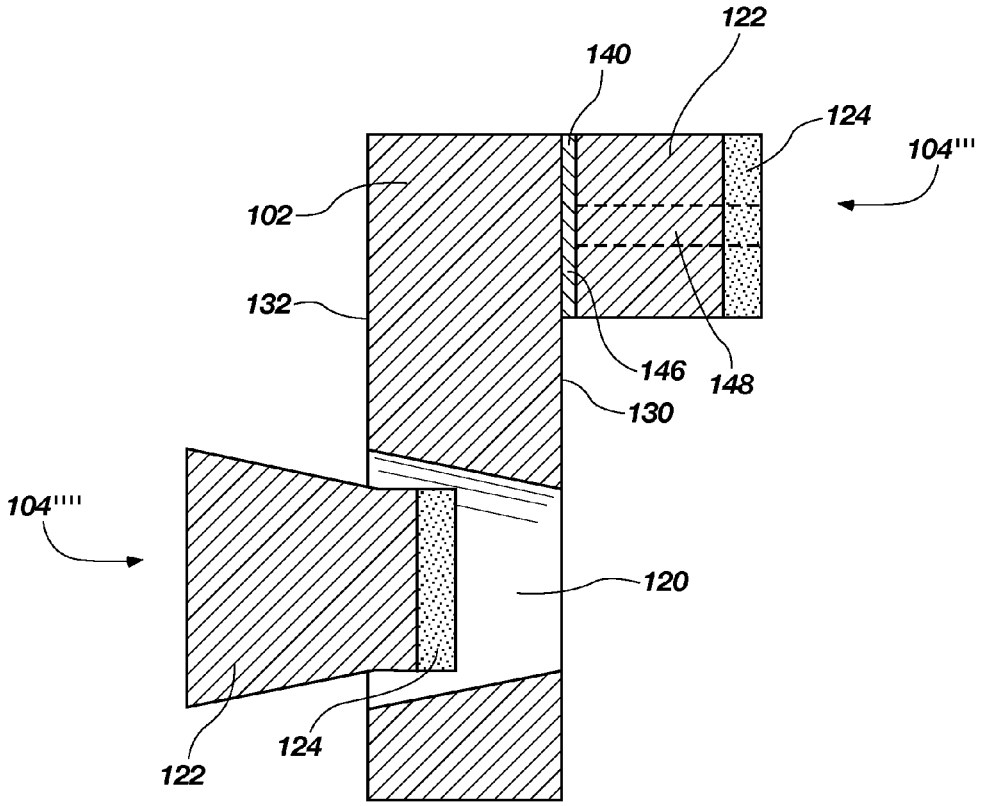
FIG. 12 illustrates a cross-sectional view of a plurality of cutting elements secured to a blade segment.

Referring to FIG. 12, a plurality of cutting elements 104 configured to be secured to a blade frame segment 102 is shown. A first cutting element 104''' may be secured to the blade frame segment 102 using a braze 146. Another cutting element 104''' may be secured to the blade frame segment 102 using mechanical interference. The first cutting element 104''' may be located on the blade frame segment 102 in a position configured to form a portion of a face 110 of an earth-boring tool 100 (see FIG. 1). Thus, cutting elements 104 may be secured to the blade frame segment 102 using any of the previously described means, and combinations thereof may be used to secure different cutting elements to a common blade frame segment 102.

In addition, the first cutting element 104''' may be configured to detach from the blade frame segment after a predetermined amount of wear has occurred. For example, the first cutting element 104''' may include a portion of reduced strength 148 in the substrate 122, in the polycrystalline structure 124, or both. The portion of reduced strength 148 may be positioned within the cutting element 104''' such that, after a predetermined amount of wear has occurred, the cutting element 104''' fails, for example, within the portion of reduced strength 148. The portion of reduced strength 148 may include, for example, a preformed void or series of voids that propagate into cracks after a predetermined amount of wear, a region of material exhibiting less strength, a region of material having a lower density, or other weakening mechanisms known in the art. Thus, the portion of reduced strength 148 may enable the cutting element 104'∝ to become detached in a more controlled or predictable manner.

Figure 13:
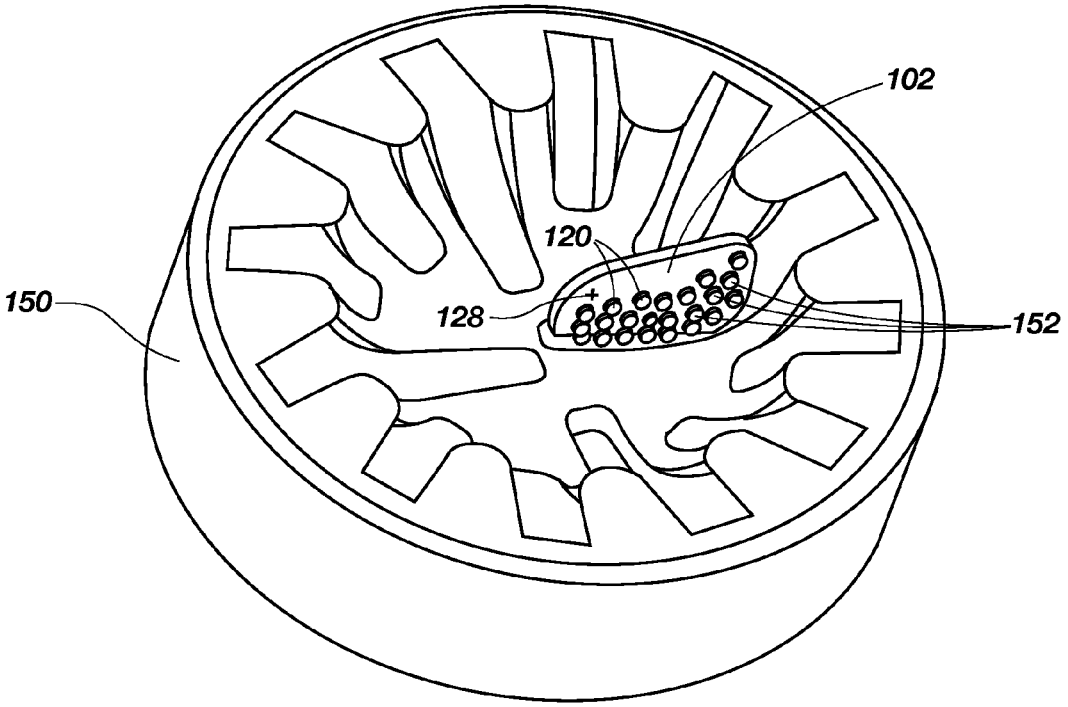
FIG. 13 is a perspective view of a blade segment disposed in a mold.

Referring to FIG. 13, a blade frame segment 102 is shown disposed in a mold 150. In such an embodiment, the resulting earth-boring tool 100 may include only a single blade frame segment 102, the remainder of the blades not having a blade frame segment 102 attached thereto. When making an earth-boring tool 100, such as, for example, those shown in FIGS. 1 and 2, the blade frame segment 102 configured to receive a plurality of cutting elements (e.g., in the plurality of pockets 120 formed therein or attached at placement markings 128 thereon) may be disposed in a mold 150. The mold 150 may be configured to form a body of an earth-boring tool 100 (see FIG. 1), such as, for example, a body 108 of a fixed-cutter drill bit and radially extending blades thereof. A plurality of placeholder inserts 152, which may also be characterized as displacements, may be disposed within the pockets 120 formed in the blade frame segment 102. The placeholder inserts 152 may comprise a shape at least substantially similar to cutting elements 104 (see FIG. 12) that may subsequently be attached to the blade frame segment 102. The placeholder inserts 152 may be formed from, for example, graphite, resin-coated sand, or other materials used as placeholder inserts in processes for forming earth-boring tools 100 as known in the art. The placeholder inserts 152 may prevent other material used to form an earth-boring tool body in mold 150 from infiltrating or occupying space or positions where cutting elements 104 (see FIG. 12) may subsequently be disposed. The blade frame segment 102 may be disposed in a portion of the mold 150 configured to form blades of an earth-boring tool 100 (see FIG. 1) and, more specifically, in a portion of the mold 150 configured to form a rotationally leading portion of the blade.

Figure 14:
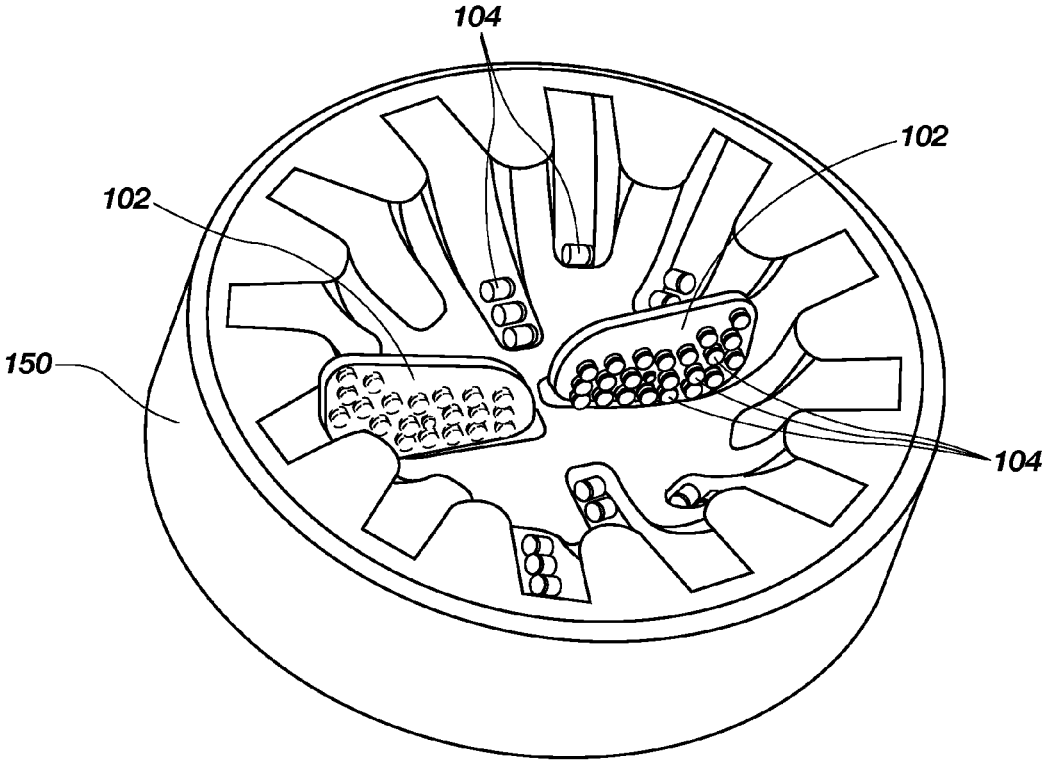
FIG. 14 depicts a perspective view of a plurality of blade segments having cutting elements attached thereto and cutting elements free of attachment to the blade segments disposed in a mold.

Referring to FIG. 14, a plurality of blade frame segments 102 having cutting elements 104 attached thereto are shown disposed in a mold 150. In such an embodiment, the resulting earth-boring tool 100 (see FIG. 1) may include some blades that do not have blade frame segments 102 attached thereto. Thus, some, but not all, of the blades may be formed from blade frame segments 102 attached to support segments comprising remainders of blades 106. In other embodiments, each blade may include a blade frame segment 102 attached to a remainder of a blade 106 (see FIG. 1). At least some of the cutting elements 104, such as, for example, thermally stable cutting elements 104 that include a polycrystalline structure 124 (see FIG. 10), referenced above as TSPs, may be coated with a protective material 140, a bonding material, or both. The protective and/or bonding material 140 may enhance bonding of the material of the earth-boring tool body to the polycrystalline structure 124 of the TSPs during formation of a body of an earth-boring tool 100 (see FIG. 1) and prevent chemical damage to the TSP material from the manufacturing process. Natural diamonds, which are themselves thermally stable, may, for example, be used in place of, or in addition to, TSPs in a coated or uncoated form.

In addition to the cutting elements 104 attached to the blade frame segments 102, cutting elements 104 comprising TSPs or natural diamonds that are not attached to the blade frame segments 102 may be placed in the mold 150. The cutting elements 104 may be placed in portions of the mold 150 configured to form blades that do not comprise blade frame segments 102. In addition or in the alternative, the cutting elements 104 may be placed in portions of the mold configured to form blades that comprise blade frame segments 102, such as, for example, in portions of the mold configured to from regions of a blade of an earth-boring tool 100 (see FIG. 2) where cutting elements 104 attached to the blade frame segments 102 may not be initially exposed for engagement with an earth formation. For example, the cutting elements 104 not attached to the blade frame segments 102 may be disposed in at least one of portions of the mold 150 configured to form the cone region, the nose region, the shoulder region, and the gage region of an earth-boring tool 100 (see FIG. 2).

Figure 15:
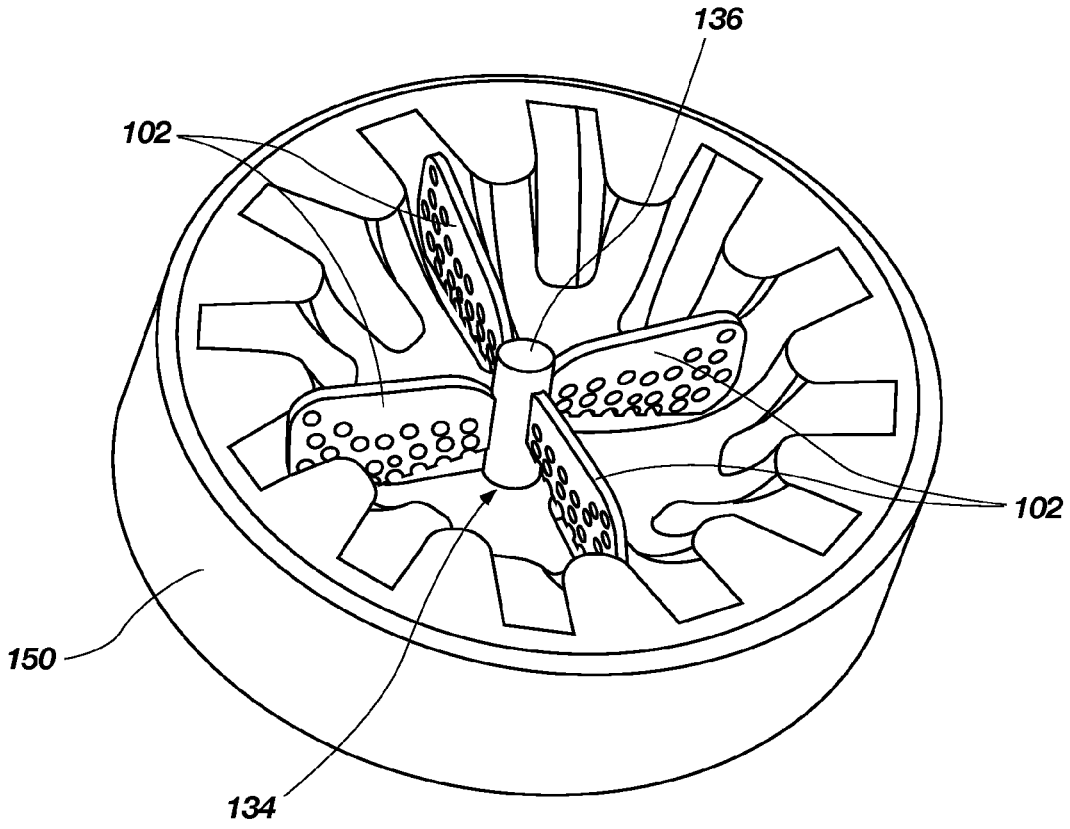
FIG. 15 illustrates a perspective view of a support structure including a plurality of blade segments disposed in a mold.

Referring to FIG. 15, a support structure 134 including a plurality of blade frame segments 102 is shown disposed in a mold 150. The blade frame segments 102 may be at least substantially the same in some embodiments, having pockets 120 and/or placement markings 128 located at positions of the blade frame segments 102 that are at least substantially the same. In other embodiments, the blade frame segments 102 may be different and include pockets 120 and/or placement markings 128 located at positions on the blade frame segments 102 that differ and form different cutting profiles (see FIG. 2). The blade frame segments 102 attached to the central support member 136 may occupy portions of the mold 150 configured to form each blade of a resulting earth-boring tool 100 (see FIG. 1) or may occupy only some of the portions of the mold 150 configured to from blades of a resulting earth-boring tool 100.

After disposing at least one blade frame segment 102 in a mold 150, such as, for example, those blade frame segments 102 in molds 150 shown in FIGS. 13 through 15, a body 108 of an earth-boring tool 100 (see FIG. 1) may be formed in the mold 150. For example, a body 108 comprising a particle matrix composite material may be formed in the mold 150 by sintering. Thus, a plurality of particles comprising a hard material suitable for use in earth-boring applications may be disposed in the mold 150. The particles of hard material of the body 108 may comprise, for example, ceramic particles (e.g., carbides, nitrides, oxides, and borides (including boron carbide ($B_4C$)) such as those described previously in connection with the cutting element 104 substrate 122) or metal particles (e.g., steel, aluminum, and alloys of steel and aluminum). A plurality of particles of a matrix material may also be disposed in the mold 150. The matrix material may comprise, for example, steel, copper, aluminum, and alloys and mixtures of steel, copper, and aluminum. The particles of a hard material and the particles of a matrix material may then be subjected to a sintering process in the mold 150 to form the particle matrix composite material of the body 108. In some embodiments, the sintering may be accompanied by application of pressure (e.g., isostatic pressure) to the mold 150 and the materials and structures therein. During sintering of the particles of hard material and the particles of a matrix material to form the body 108 of the earth-boring tool 100, the at least one blade frame segment 102 may become attached to the remainders of blades 106 (e.g., by shrinkage of the body 108 to capture the at least one blade frame segment 102, by bonding of the material of the body 108 to the material of the at least one blade frame segment 102, and/or by infiltration of the blade frame segment 102 by the matrix material of the body 108). Placeholder inserts 152 (not shown in FIGS. 14 and 15) in the form of displacements, TSPs, natural diamonds, or a combination thereof may be placed in pockets in the blade frame segments 102 or pre-bonded to blade frame segments 102.

As another example, a body 108 comprising a particle matrix composite material may be formed in the mold 150 by an infiltration process. Thus, a plurality of particles comprising a hard material suitable for use in earth-boring applications (e.g., any of those hard materials described previously in connection with the sintering process) may be disposed in the mold 150. A matrix material may then be infiltrated among the plurality of particles of hard material to form the particle matrix composite material of the body 108. The matrix material may comprise, for example, iron, copper, aluminum, and alloys and mixtures of iron, copper, and aluminum. During infiltration of the particles of hard material with the matrix material to form the body 108 of the earth-boring tool 100, the at least one blade frame segment 102 may become attached to the remainders of blades 106 (e.g., by bonding of the material of the body 108 to the material of the at least one blade frame segment 102 and/or by infiltration of the blade frame segment 102 by the matrix material of the body 108).

Figure 16:
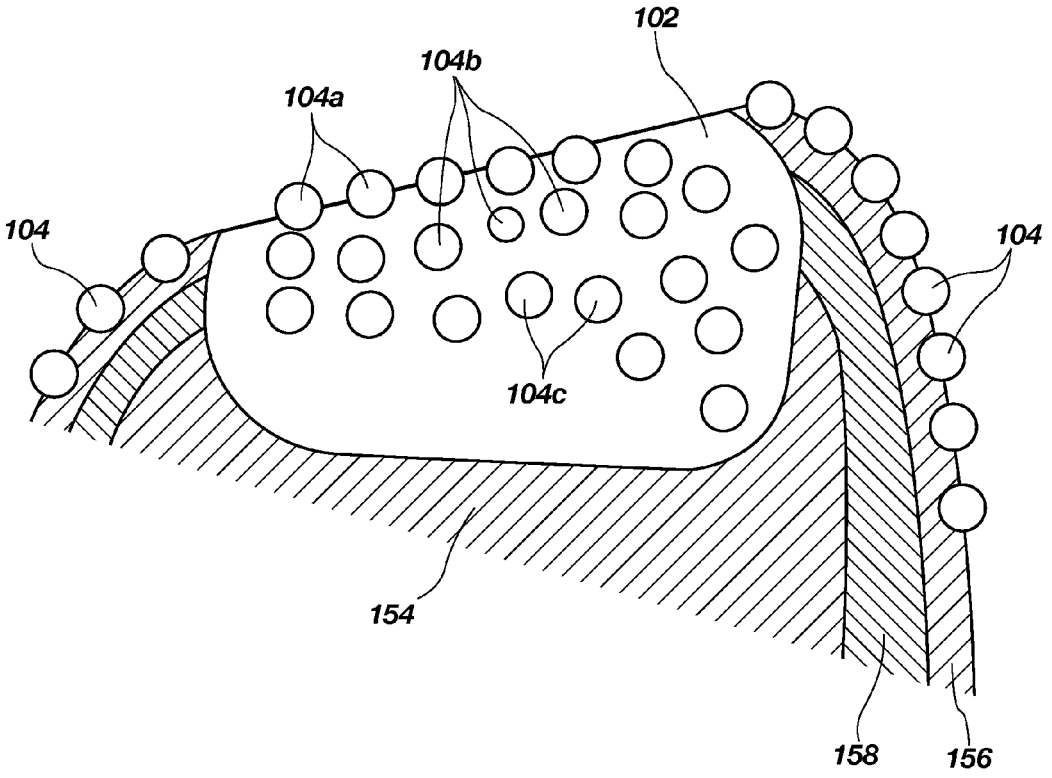
FIG. 16 is a cross-sectional view of a portion of a bit body including a blade segment attached to a remainder of a blade.

In embodiments where a sintering or an infiltration process is used to form the body 108, regions within the body 108 may have different material compositions, as shown in FIG. 16. For example, a central region 154 near the center of the body 108 may comprise a relatively harder and more abrasion resistant material composition than the remainder of the body 108. Thus, as the remainder of the body 108 wears away, and the new cutting elements 104 of the blade frame segments 102 are exposed, a change in the rate of penetration caused by a subterranean formation engaging the relatively harder and more abrasion resistant center portion of the body 108 may signal to an operator that the useful life of the earth-boring tool 100 is at an end and replacement is desirable. Further, regions of the body 108 associated with different rows of cutting elements (e.g., cutting elements 104*a*, 104*b*, and 104*c*) may comprise material compositions of differing strength and abrasion resistance. For example, an outer region 156 of the body 108 (corresponding generally to cutting elements 104*a*) may comprise a material composition of relatively low strength and abrasion resistance to enable cutting elements 104*a* to become more easily detached from the earth-boring tool 100 to expose new cutting elements 104*b*. Likewise, an intermediate region 158 may comprise a material composition of intermediate strength and abrasion resistance to enable cutting elements 104*b* to resist detachment longer than cutting elements 104*a*, but not as long as cutting elements 104*c*. Thus, the material composition of the body 108 may form a gradient of desirable material properties throughout the body 108 of the earth-boring tool 100.

Returning to FIGS. 13 through 15, another example of a process that may be used to form a body 108 of an earth-boring tool 100, including a plurality of radially extending blades, comprises a casting process. Thus, after disposing at least one blade frame segment 102 in the mold 150, a body 108 of an earth-boring tool 100 including a remainder of at least one blade 106 may be cast in the mold. The material used for casting may comprise, for example, iron, copper, aluminum, and alloys of iron, copper, or aluminum. During casting of the body 108 of the earth-boring tool 100, the at least one blade frame segment 102 may become attached to the remainders of blades 106 (e.g., by bonding of the material of the body 108 to the material of the at least one blade frame segment 102 and/or by infiltration of the blade frame segment 102 by the molten material of the body 108).

As the blade frame segments 102 may be located at a rotationally leading portion of the blades, the remainder of the blade frames 106 may be subjected to less abrasion, and reduced vibration. Thus, the material of the body 108, including the remainders of the blades 106, may be formed from a material that is not as hard and abrasion-resistant as, and less expensive than, the material of the blade frame segments 102. In addition, the material of the body 108 may comprise a relatively tougher and more ductile, and thus more impact-resistant, material than the material of the blade frame segments 102. In some embodiments, for example, in bits used for casing or liner drilling, as well as in milling tools, the material of blade frame segments 102 and of body 108 may be selected to facilitate drillout by another tool subsequent to completion of the initial drilling or milling operation. Thus, the blade frame segments 102 may enable use of a larger variety of application-specific materials in the earth-boring tool 100 and may be used to reduce the cost of forming the earth-boring tool 100.

In embodiments where all the cutting elements 104 for attachment to the earth-boring tool 100 are disposed in the mold 150 prior to forming the body 108 of the earth-boring tool, subsequent attachment of cutting elements 104 may be unnecessary. Further, where cutting elements 104 are attached to the at least one blade frame segment 102 before the at least one blade frame segment 102 is disposed in the mold 105, the blade frame segment 102 may prevent the cutting elements 104 from settling, floating, or otherwise becoming displaced in the mold 150 during formation of the body 108 of the earth-boring tool 100. Thus, the at least one blade frame segment 102 may enable precise placement and attachment of the cutting elements 104 with respect to the earth-boring tool 100.

Figure 17:
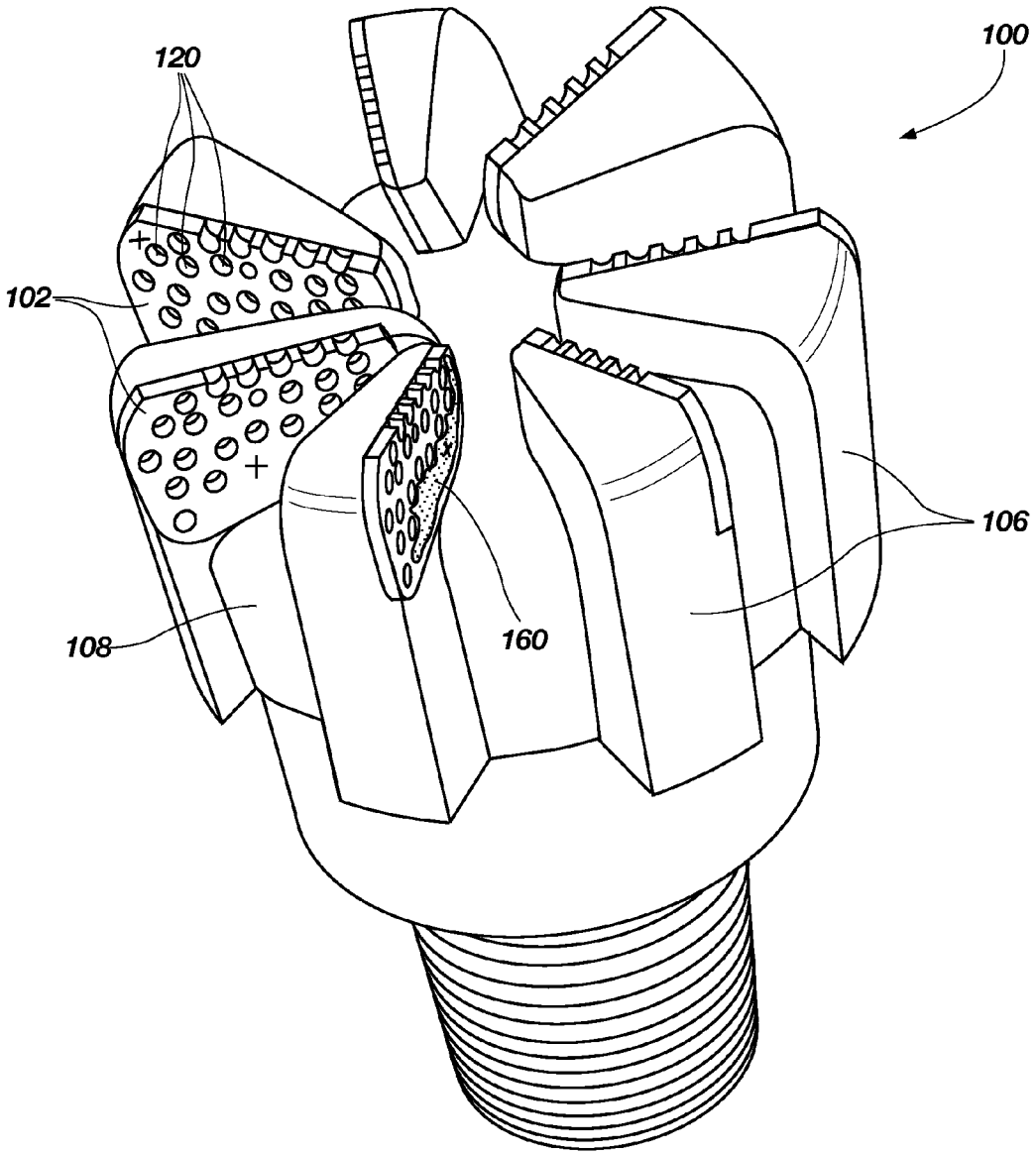
FIG. 17 is a perspective view of an earth-boring tool including blade segments attached to remainders of blades and to which cutting elements may be secured.

Referring to FIG. 17, an earth-boring tool 100 including blade frame segments 102 attached to support segments comprising remainders of blades 106 and to which cutting elements 104 (see FIG. 1) may be secured is shown. In embodiments where the blade frame segments 102 are attached to remainders of blades 106 during formation of the body 108 of the earth-boring tool 100, such as, for example, by sintering, infiltrating, or casting the body 108 at least partially around the blade frame segments 102 in a mold 150 (see FIGS. 13 through 15), placeholder inserts 152 (see FIG. 13) may be subsequently destroyed, disintegrated, or otherwise removed from the blade frame segments 102 and from other places in which similar placeholder inserts may be disposed, such as, for example, in internal features of the body 108. Cutting elements 104 may then be attached to the blade frame segment 102, for example, within pockets 120 formed therein or at placement markings 128 formed thereon. In embodiments where the body 108 of the earth-boring tool 100 is formed separately, at least one blade frame segment 102 may be subsequently attached to the body 108 at rotationally leading portions of remainders of blades 106. For example, the at least one blade frame segment 102 may be attached by brazing, welding, mechanical interference (e.g., using a mortise and tenon joint), or bolting to support segments comprising the remainders of blades 106. In such embodiments, cutting elements 104 may already be attached to the at least one blade frame segment 102 or may be subsequently attached thereto. In any of the foregoing embodiments, hardfacing material 160 may be deposited on the blade frame segments 102, for example before the displacements comprising placeholder inserts are removed, to further increase the wear resistance of the blade frame segments 102 in areas not populated with cutting elements.

While the present invention has been described herein with respect to certain embodiments, those of ordinary skill in the art will recognize and appreciate that it is not so limited. Rather, many additions, deletions, and modifications to the embodiments described herein may be made without departing from the scope of the invention as hereinafter claimed, including legal equivalents. In addition, features from one embodiment may be combined with features of another embodiment while still being encompassed within the scope of the invention as contemplated by the inventor.

What is claimed is:

1. A method of forming an earth-boring tool, comprising:

positioning a blade frame segment, a first cutting element, and a second cutting element in a mold, the mold comprising a longitudinal axis, the first cutting element being positioned at a first location adjacent to the blade frame segment at a first radial distance from the longitudinal axis and at a first position along the longitudinal axis, the second cutting element being positioned at a second, different location adjacent to the blade frame segment at a second, different radial distance from the longitudinal axis and at a second, different longitudinal position along the longitudinal axis, a radial footprint of the first cutting element at least partially overlapping with a radial footprint of the second cutting element, the second cutting element being located farther from a periphery of the blade frame segment than the first cutting element; and integrating the blade frame segment into a blade of a plurality of radially extending blades of an earth-boring tool, to secure the first and second cutting elements to the blade, by forming a body of the earth-boring tool, including the blade, around the blade frame segment.

2. The method of claim 1, further comprising securing the first and second cutting elements to a face of the blade frame segment before integrating the blade frame segment into the blade.

3. The method of claim 2, further comprising placing other cutting elements not secured to the blade frame segment in a region of the mold configured to form another blade before forming the body of the earth-boring tool.

4. The method of claim 1, wherein forming the body comprises:

placing a plurality of particles of a hard material in the mold in contact with the blade frame segment; and infiltrating the plurality of particles with a matrix material.

5. The method of claim 1, wherein forming the body comprises:

placing a first plurality of particles of a hard material and a second plurality of particles of a matrix material in a mold in contact with the blade frame segment; and sintering the first and second pluralities of particles.

6. The method of claim 1, wherein the blade frame segment comprises pockets extending into the blade frame segment and further comprising placing the first and second cutting elements within respective pockets of the blade frame segment.

7. The method of claim 6, wherein placing the first and second cutting elements within the respective pockets comprises mechanically securing at least one of the first and second cutting elements at least partially within a frustoconical pocket formed in the blade frame segment.

8. The method of claim 1, further comprising at least partially coating at least one of the first and second cutting elements with at least one of a bond-enhance and a protective material before forming the body.

9. The method of claim 8, further comprising securing the first and second cutting elements to the blade frame segment by brazing the first and second cutting elements to the blade frame segment before forming the body.

10. The method of claim 9, wherein brazing the first and second cutting elements to the blade frame segment comprises brazing at least one of the first and second cutting elements at least partially within a pocket in the blade frame segment.

11. The method of claim 1, wherein integrating the blade frame segment into the blade of the earth-boring tool comprises leaving at least a portion of the blade frame segment exposed outside a periphery of the blade of the earth-boring tool.

12. The method of claim 1, wherein integrating the blade frame segment into the blade of the earth-boring tool comprises embedding at least a portion of the blade frame segment and at least a portion of the second cutting element within a periphery of the blade of the earth-boring tool.

13. The method of claim 12, wherein embedding the at least a portion of the second cutting element within the periphery of the blade of the earth-boring tool comprises embedding an entirety of the second cutting element within the periphery of the blade of the earth-boring tool.

14. The method of claim 1, further comprising:

positioning at least another blade frame segment and at least another cutting element in the mold, the at least another cutting element being located at another location at another radial distance from the longitudinal axis and at another position along the longitudinal axis, the other radial distance being different from the first and second distances, the other position being different from the first and second positions;

integrating the at least another blade frame segment into another blade of the plurality of blades of the earth-boring tool, to secure the other cutting element to the other blade, by forming the body of the earth-boring tool, including the other blade, around the at least another blade frame segment.

15. A method of forming an earth-boring tool, comprising:

positioning blade frame segments, a first cutting element, and a second cutting element in a mold, the mold comprising a longitudinal axis, the first cutting element being located at a first location abutting one of the blade frame segments at a first radial distance from the longitudinal axis and at a first position along the longitudinal axis, the second cutting element to being located at a second, different location abutting the one of the blade frame segments at a second, different radial distance from the longitudinal axis and at a second, different longitudinal position along the longitudinal axis, a radial footprint of the first cutting element at least partially overlapping with a radial footprint of the second cutting element, the second cutting element being located farther from a periphery of the one of the blade frame segments than the first cutting element; and integrating each of the blade frame segments into a respective blade of a plurality of radially extending blades of an earth-boring tool, to secure the first and second cutting elements to the respective blade associated with the one of the blade frame segments, by forming a body of the earth-boring tool, including each respective blade, around each of the blade frame segments.

16. The method of claim 15, wherein integrating each of the blade frame segments into a respective blade of the earth-boring tool comprises embedding at least a portion of the one of the blade frame segments and at least a portion of the second cutting element within a periphery of the respective blade of the earth-boring tool.

17. The method of claim 16, wherein embedding the at least a portion of the second cutting element within the periphery of the respective blade of the earth-boring tool comprises embedding an entirety of the second cutting element within the periphery of the respective blade of the earth-boring tool.

18. The method of claim 15, further comprising placing the first and second cutting elements within pockets of the one of the blade frame segments.

19. The method of claim 18, wherein placing the first and second cutting elements within the respective pockets comprises mechanically securing at least one of the first and second cutting elements at least partially within a frusto-conical pocket formed in the one of the blade frame segments.

20. The method of claim 15, further comprising securing the first and second cutting elements to the one of the blade frame segments by brazing the first and second cutting elements to the one of the blade frame segments before forming the body.

* * * * *